US005921088A

United States Patent [19]

Imaizumi et al.

[11] Patent Number: 5,921,088

[45] **Date of Patent: *Jul. 13, 1999**

[54] AIR CONDITIONING APPARATUS

[75] Inventors: Hisaakira Imaizumi; Kanichi Kadotani; Bunji Hayakashi; Tetsuo Syakushi; Toshihiko Matsumoto; Genichiro Watanabe; Toshihide Imamura, all of Kanagawa-ken, Japan

[73] Assignee: Komatsu Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/750,596

[22] PCT Filed: Apr. 6, 1995

[86] PCT No.: PCT/JP95/00682

§ 371 Date: Dec. 18, 1996

§ 102(e) Date: Dec. 18, 1996

[87] PCT Pub. No.: WO96/01397

PCT Pub. Date: Jan. 18, 1996

[30] Foreign Application Priority Data

Jul. 1, 1994 [JP] Japan ..... 6-150899

[51] Int. Cl.[6] ..... F24F 1/00

[52] U.S. Cl. ..... 62/3.4; 62/92; 62/271

[58] Field of Search ..... 62/3.2, 3.3, 3.7, 62/3.4, 3.5, 92, 93, 91, 271, 304

[56] References Cited

U.S. PATENT DOCUMENTS

| | | | |
|---|---|---|---|
| 2,170,993 | 8/1939 | Grady | 62/93 |
| 2,209,661 | 7/1940 | Pickstone | 62/93 |
| 2,783,616 | 3/1957 | Dodge | 62/92 |
| 2,783,623 | 3/1957 | Dodge | 62/93 |
| 2,926,506 | 3/1960 | Skaredoff | 62/93 |
| 3,196,620 | 7/1965 | Elfving | 62/3.2 |
| 4,420,940 | 12/1983 | Buffet | 62/3.2 |
| 4,428,205 | 1/1984 | Doderer | 62/93 |
| 4,450,900 | 5/1984 | Nathan | 165/42 |
| 4,918,935 | 4/1990 | Trent | 62/93 |
| 5,431,021 | 7/1995 | Gwilliam et al. | 62/3.7 |
| 5,613,364 | 3/1997 | Higgins | 62/3.2 |

FOREIGN PATENT DOCUMENTS

| | | | |
|---|---|---|---|
| 49-149547 | 12/1974 | Japan . | |
| 50-8375 | 3/1975 | Japan . | |
| 42039 | 4/1981 | Japan | 62/92 |
| 2-1113 | 1/1990 | Japan . | |
| 4-139345 | 5/1992 | Japan . | |
| 571681 | 9/1977 | U.S.S.R. | 62/92 |

*Primary Examiner*—William Doerrler
*Attorney, Agent, or Firm*—Armstrong, Westerman, Hattori, McLeland & Naughton

[57] ABSTRACT

There is provided an air conditioning apparatus including an air duct and provided therein with a blower, a heater, a humidifier and an air cooling dehumidifier comprised of an air-fluid heat exchanger, characterized in that:

the said air cooling dehumidifier is disposed at a site that is shifted transversely from an air blowing outlet of the said air duct.

6 Claims, 9 Drawing Sheets

AIR CONDITIONING APPARATUS

TECHNICAL FIELD

The present invention relates to an air conditioning apparatus for supplying an ultra-isothermic and ultra-isohumid air into an operating section (hereinafter referred to as a "cup") in a so-called spin coating equipment (hereinafter referred to as a "spin coater") or the like that is designed to coat a chemical on a semiconductor or glass substrate surface while the latter is being rotated.

BACKGROUND ART

An air conditioning apparatus of this genre in the prior art is typically constructed as disclosed, for example, in Japanese Unexamined Patent Publication No. Hei 02-1113 (relating to a regist processing apparatus) or in Japanese Unexamined Patent Publication No. Hei 04-139345 (relating to a method of and apparatus for supplying an isothermic and isohumid air).

The former typical example above in the prior art is comprised of an air cooling dehumidifier for cooling an absorbed air and dehumidifying the cooled air, a heater for heating the air so dehumidified to a predetermined temperature and a humidifier for humidifying the heated air to a predetermined humidity. And, the said air cooling dehumidifier may be comprised of a compression refrigerator in which a compressed refrigerant is passed through a pipe provided with a multiplicity of fins to cool and dehumidify the air that is brought into contact with those fins.

On the other hand, the latter typical example above in the prior art is comprised of a humidifier for humidifying an absorbed air to a predetermined humidity, an air cooling dehumidifier for cooling and dehumidifying the air so humidified, a heater for heating the humidity adjusted air to a predetermined temperature and a blower for feeding the air through these units. And, this air conditioning apparatus in which the air cooling dehumidifier and the humidifier are large and heavy is installed separately from a spin coater, and is used in a manner in which an ultra-isothermic and ultra-isohumid air is supplied into a cup via a thermally insulated duct or the like.

Incidentally, in the former typical apparatus mentioned above in which the dehumidifier is large and heavy, it has been found that the problem arises that the entire size of the air conditioning equipment in its totality must also be enlarged.

Also, owing to the fact there that it is unable to optionally adjust the air processing capacity of the apparatus, it has been found that if it is forcibly attempted to make any adjustment without regard to such an inability, the cross sectional area of an air duct must be altered.

Furthermore, vibrations are unavoidably created in the above mentioned apparatus due to the fact that use is made of a compressor for the dehumidifier therein. Hence, the problem has always been encountered that a critical measure is required in order to prevent those vibrations from adversely influencing upon a coating that is comprised of a regist or the like.

On the other hand, in the latter typical air conditioning apparatus mentioned above, it has been found that some usage thereof may introduce a thermal disturbance into a thermally insulated duct therein and thus make it difficult to adjust the temperature and humidity therein at a satisfactory precision. Also, as the spin coater is increased in its functions, there is a tendency for its equipment to be more and more large scaled. Thus, there being a tendency for a duct coupling the air conditioning apparatus and the cup together to be lengthened, there has been a fear that the accuracy at which the temperature and the humidity are adjustable may be lowered.

Furthermore, a need for reducing the floor area which the air conditioning apparatus occupies in a clean room has been increasingly demanded because the cost for maintaining the clean room is highly expensive.

These problems may be resolved by installing an air conditioning apparatus that is small sized directly upon the cup of the spin coater and thus by removing the thermally insulated duct that has coupled the air conditioning apparatus and the cup together while eliminating the flour area that has been required for the air conditioning apparatus.

In this respect, a relevant idea has been found in a "regist processing apparatus" as disclosed in Japanese Unexamined Patent Publication No. Hei 02-1113 that is listed above as the former typical example in the prior art.

If this idea is adopted, however, the resultant equipment has been found to be impractical since an amount of condensed water is allowed to drop onto a wafer and so forth because of the structure in which a vertical laminar flow is introduced directly over the said cup to carry out a dehumidification thereof. In addition, the air which is dehumidified by the said air cooling dehumidifier is humidified by the said humidifier that is located immediately below it. Then, the humidified air is heated by an heat exchanger that is located below the said humidifier. There, since the said air cooling dehumidifier is located directly above the said heater, it has been found that there develops, among others, the problem that the efficiency of dehumidification may be deteriorated owing to a heat of radiation that is emitted from the said heater and so forth.

The present invention is provided with the above mentioned problems taken into consideration and has its object to provide an air conditioning apparatus which avoids an amount of condensed water dropping from the air blowing outlet of an air duct, is much small sized as well as much light weighted compared with those utilizing a compression refrigerator in the prior art, eliminates a generation of the vibrations, realizes the implementation of an air conditioning operation that is high in its thermal efficiency while realizing the implementation of an ultra-high-precision air conditioning operation, is capable of readily altering the capacity of a heat exchanger and permits an maintenance operation of the equipment to be readily carried out.

SUMMARY OF THE INVENTION

In order to attain the object mentioned above, there is provided, in accordance with the present invention, in one form of embodiments thereof, an air conditioning apparatus which includes an air duct and is provided therein with a blower, a heater, a humidifier and an air cooling dehumidifier comprised of an air-fluid heat exchanger, and is characterized in that the said air cooling dehumidifier is disposed at a site that is shifted transversely from an air blowing outlet of the said air duct.

According to the above mentioned construction, by virtue of the fact that the said air cooling dehumidifier is disposed at a site which is shifted transversely from the said air blowing outlet, it can be seen that water droplets condensed at the said air cooling dehumidifier will not be allowed to fall from the said air blowing outlet of the said air duct 5.

In addition to the construction mentioned above, it is desirable that the said air duct be provided with a flex portion and that the said air cooling dehumidifier and the said heater be disposed ahead of and behind of the said flex portion, respectively.

Since the opposing surfaces of the said air cooling dehumidifier and the said heater are not facing so as to be directly opposite to each other in the construction mentioned above, it can be recognized that little influence will then be exerted upon the said air cooling unit by the radiation that is emitted from the said heater, thereby preventing the dehumidifying effect from being reduced.

Further, in addition to the construction mentioned above, it is desirable that a heat absorbing plate and a heat emitting plate in the above mentioned fluid-fluid heat exchanger be arranged and stacked upon one upon the other so that a path disposed in the said heat absorbing plate and a path disposed in the said heat emitting plate may extend orthogonally to each other and a Peltier element be interposed between the heat absorbing plate and the heat emitting plate mentioned above.

If this construction is adopted, it can been seen that the said fluid-fluid heat exchanger will allow the said coolant (refrigerant) and the said cooling water flowing therethrough to be heat exchanged efficiently, owing to the fact that they are flowing orthogonally to each other.

In this connection, it should be noted that an alternative arrangement may be adopted in which the said heat absorbing plate and the said heat emitting plate in the above mentioned fluid-fluid heat exchanger is arranged and stacked upon one upon the other so that the said path disposed in the said heat absorbing plate and the said path disposed in the said heat emitting plate may extend in parallel to each other and a Peltier element is interposed between the heat absorbing plate and the heat emitting plate mentioned above.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

BEST MODES FOR CARRYING OUT THE INVENTION

Hereinafter, suitable embodiments of the present invention with respect to an air conditioning apparatus will be set forth with reference to the accompanying drawings.

Figure 1:
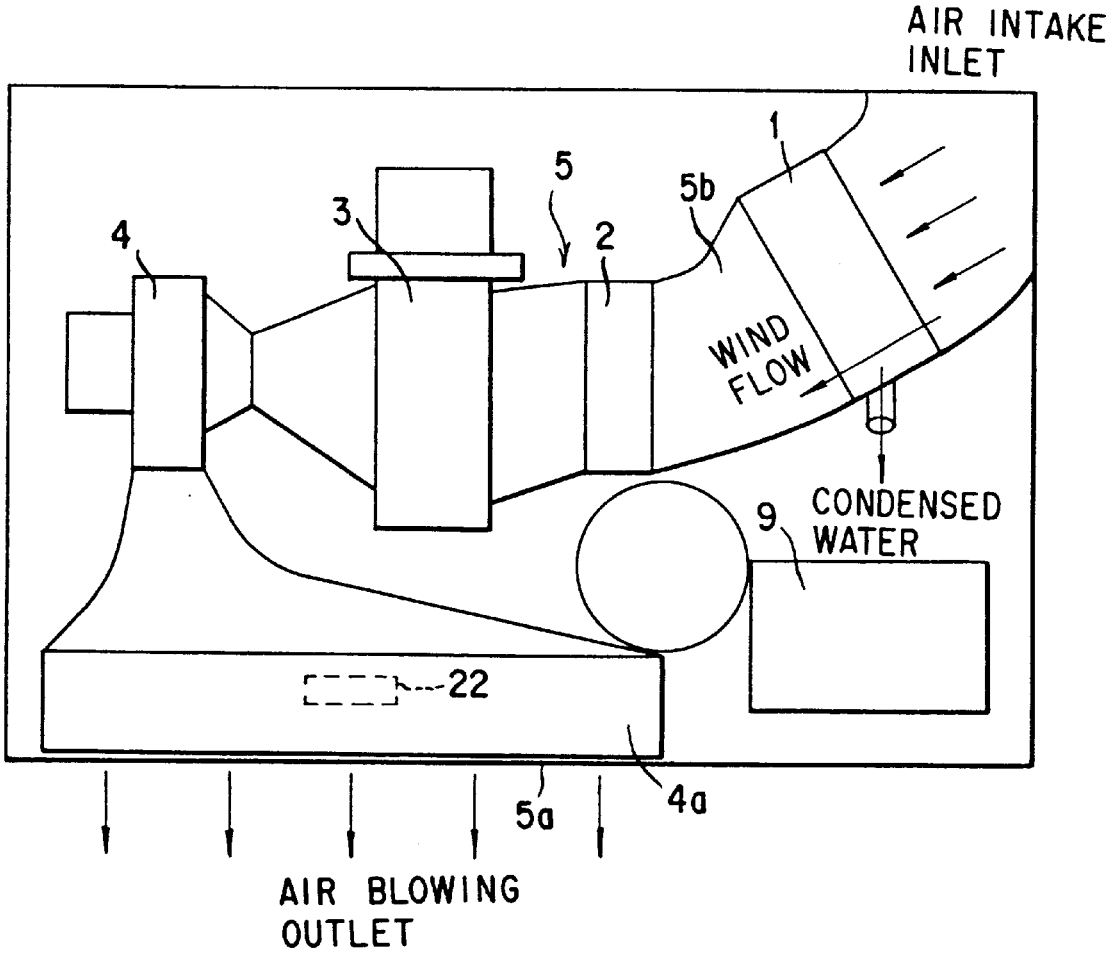
FIG. 1 is an entire constructive view illustrating a certain embodiment of the air conditioning apparatus according to the present invention.

FIG. 1 shows a diagrammatic construction of a first embodiment of the air conditioning apparatus according to the present invention. In the drawings, numeral 1 designates an air cooling dehumidifier, numeral 2 denotes a heater, numeral 3 represents a humidifier and numeral 4 indicates a blower, and these units are disposed in series in a flexed air duct 5. And, an air that is drawn by the blower 4 will be cooled and dehumidified while it is passed through the cooling dehumidifier 1, the dehumidified air will be elevated in temperature through the heater 2, and the heated air will be humidified through the humidifier 3 to yield an air stream of a predetermined humidity and temperature which will be supplied through a filter 4*a* such as a ULPA filter disposed downstreams of the blower 4, where it is dusted and rectified, into an operation section (such as a cup) of a spin coater or the like where it is performing an air conditioning operation.

The air cooling humidifier 1 and the heater 2 mentioned above are disposed at both sides of a flex portion of the air duct 5 and are arranged so that their respective opposing surfaces may be facing not to be directly opposite to each other. Thus, the air flows which are passed these units, respectively, will be oriented in different directions, forming an angle between them.

Also, the above mentioned air cooling dehumidifier 1 is disposed at a site that is shifted transversely from the air blowing outlet 5*a* of the air duct 5 so that water droplets which are condensed on the said air cooling dehumidifier 1 may not fall onto the said truck air blowing outlet 5*a*.

In order to realize the implementation of an ultra-high-precision air conditioning operation with an accuracy of ±0.01° C., it should be noted here that the blower 4 is selected from one that is provided with a servo mechanism for the rate of its rotation to quantify constant the rate of the air that is to be processed.

Figure 2:
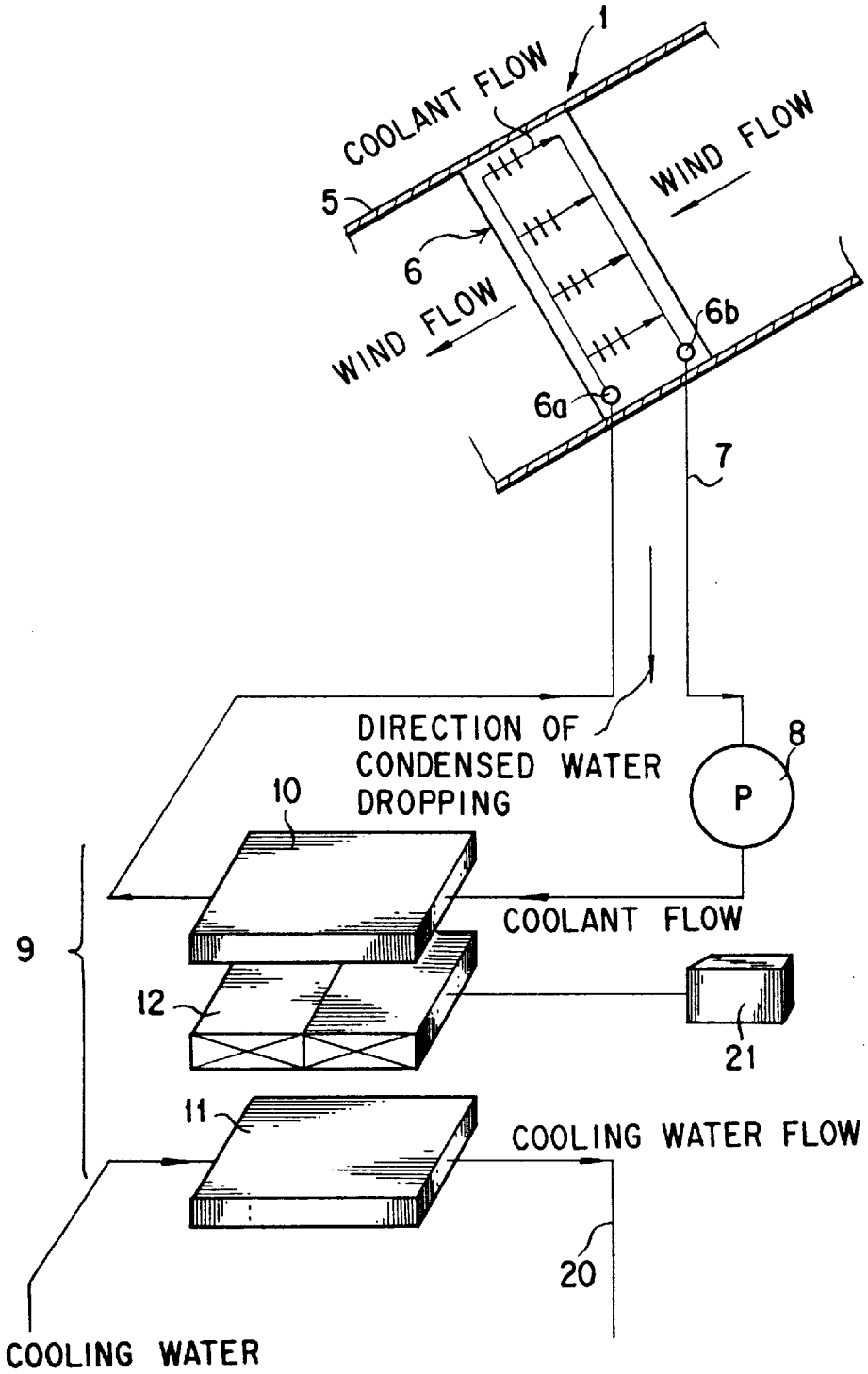
FIG. 2 is a schematic constructive view diagrammatically illustrating a certain example of the fluid-fluid heat exchanger for connection to an air cooling dehumidifier that can be used in the above mentioned embodiment of the present invention.

The above mentioned air cooling dehumidifier 1, as shown in FIG. 2, has a construction in which an air-fluid heat exchanger 6 through which a coolant (i.e. a refrigerant) flows is arranged in the air duct 5 so that the air passing through the said air duct 5 may be cooled by contacting with an external surface of the air-fluid heat exchanger 6. And, this air-fluid heat exchanger 6 has a coolant flow inlet 6*a* which is disposed downstreams for the wind flow and a coolant flow outlet 6*b* which is disposed upstreams for the wind flow so that the coolant in the said air-fluid heat exchanger 6 may flow in the direction from the downstream side to the upstream side of the wind which is flowing through the said air-fluid heat exchanger 6. The coolant flow inlet 6*a* and the coolant flow outlet 6*b* mentioned above are connected to a fluid-fluid heat exchanger 9 via a cooling circuit 7 that is provided therein with a pump 8.

The above mentioned fluid-fluid heat exchanger 9, as shown in FIG. 2, has a construction in which a heat absorbing passage 10 through which the coolant flows and a heat exhausting passage 11 through which the cooling water flows are stacked one upon the other via a Peltier element 12. And, the said heat absorbing passage 10 and the said heat exhausting passage 11 are so arranged that the coolant and the cooling water in the said fluid-fluid heat exchanger 9 flow in mutually opposite directions as shown in FIG. 2 or in mutually transverse directions as in a concrete example of construction as will be described later herein.

FIGS. 3 to 6 collectively show a concrete construction of the above mentioned fluid-fluid heat exchanger 9. In this connection, it should be noted that this construction constitutes a configuration in which each of a plurality of such heat absorbing passages 10 and each of a plurality of such heat exhausting passages 11 are alternately stacked one upon the other via a said Peltier element 12.

Figure 3:
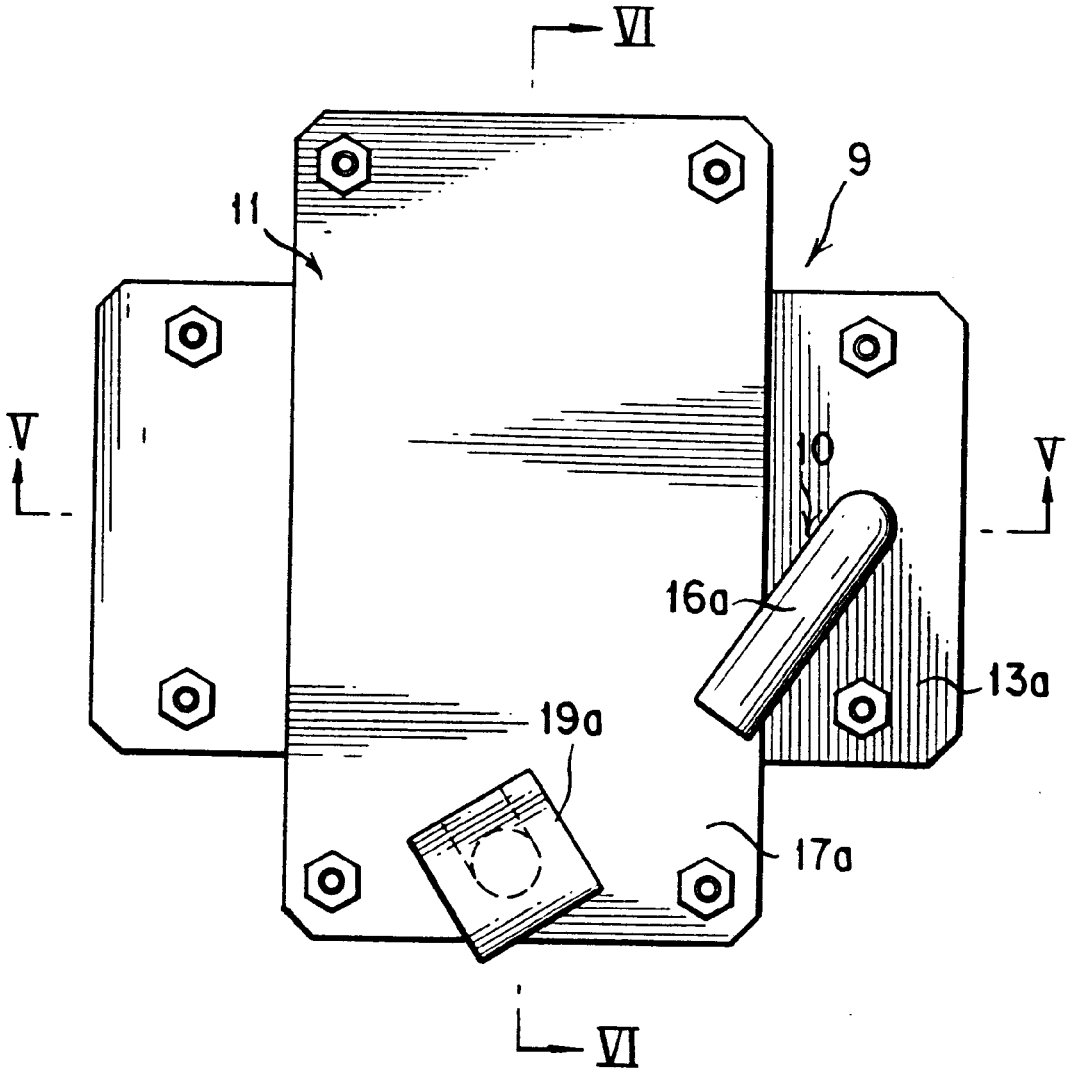
FIG. 3 is a top plan view illustrating the fluid-fluid heat exchanger for use in the above mentioned embodiment of the present invention.
Figure 4:
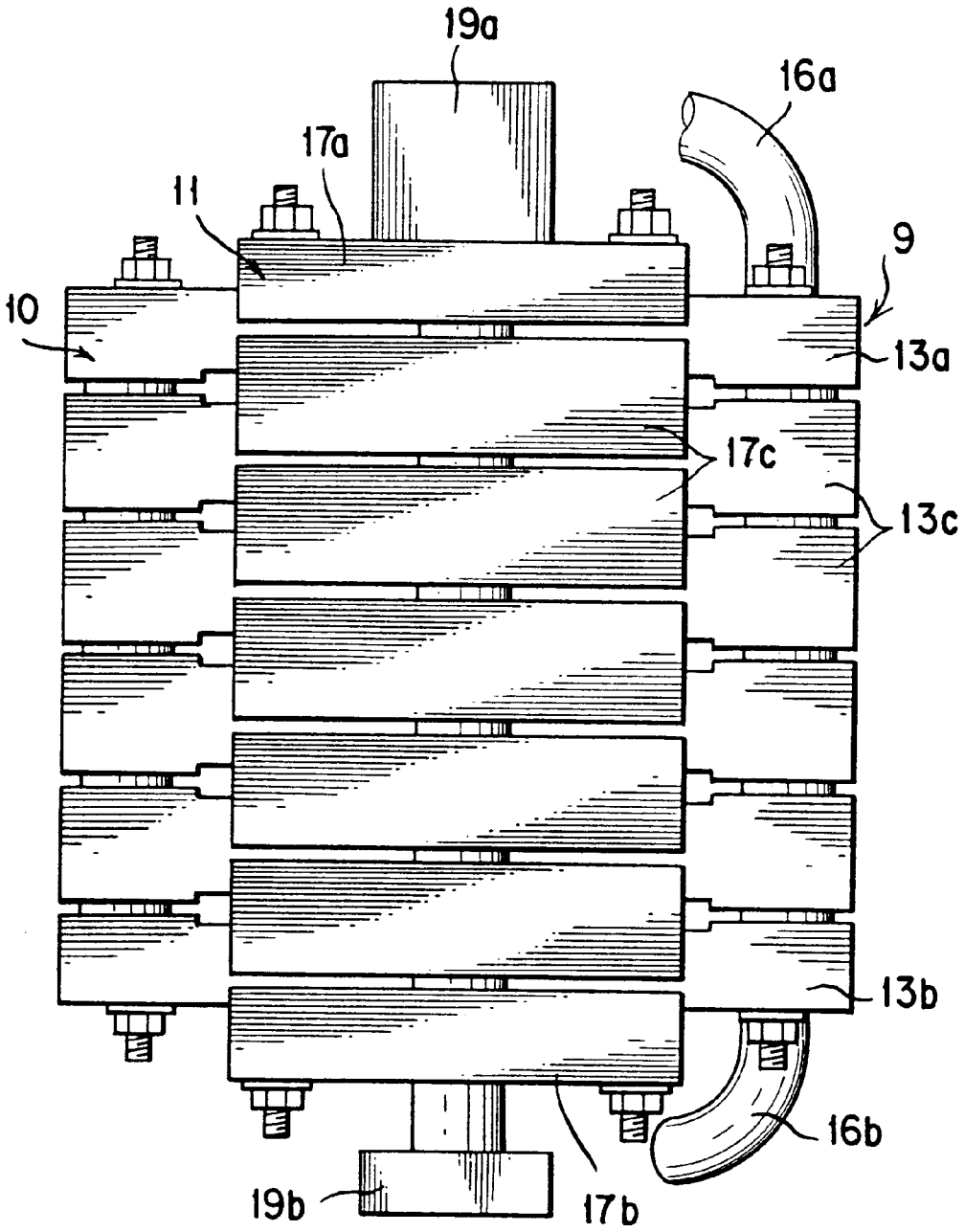
FIG. 4 is a front view illustrating the above mentioned fluid-fluid heat exchanger.
Figure 5:
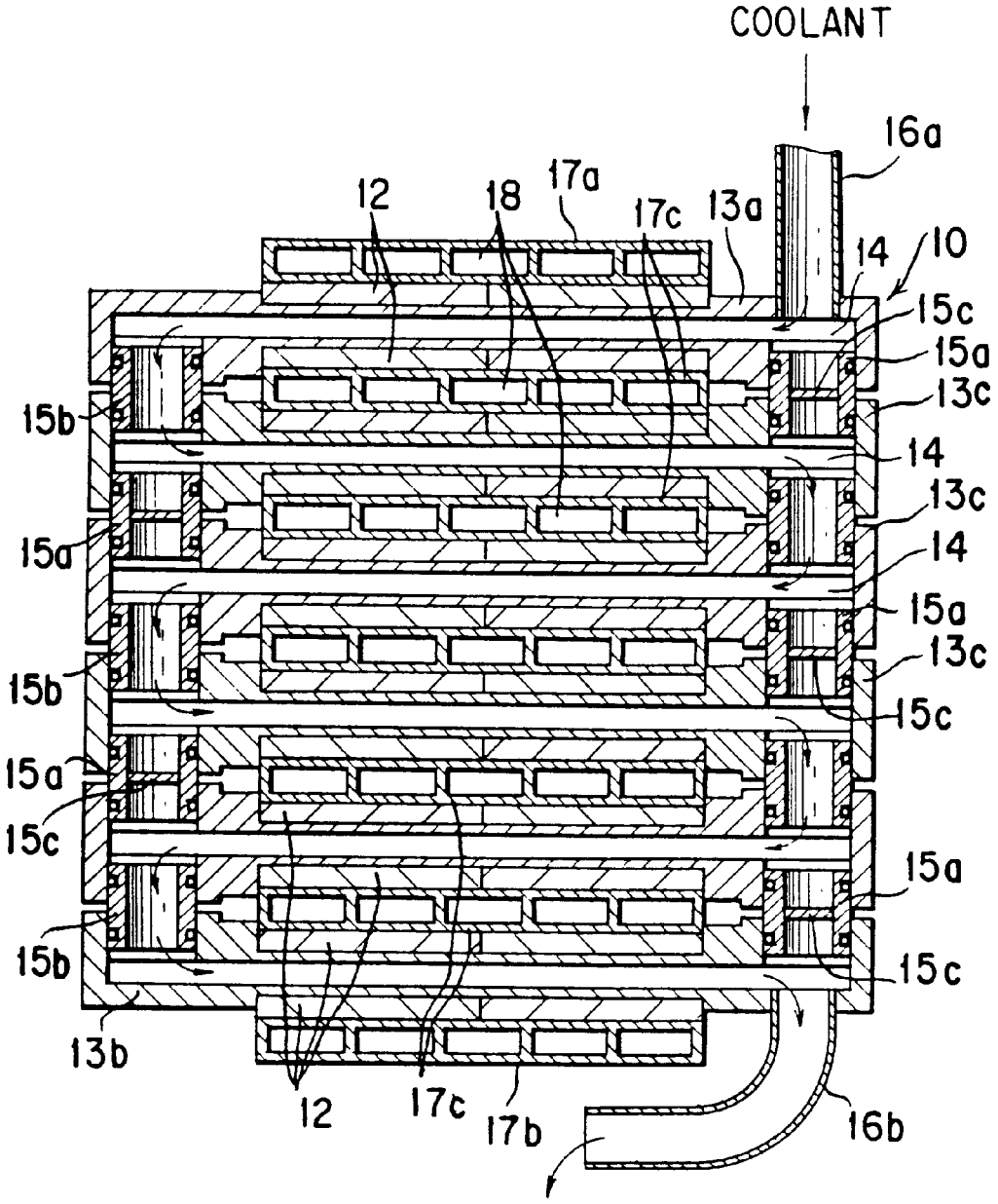
FIG. 5 is a cross sectional view taken along the line V—V of FIG. 3.

FIGS. 3 and 4 shows a planar and a frontal configuration of the above mentioned fluid-fluid heat exchanger 9, respectively. FIG. 5 shows its cross sectional configuration, a cross sectional view taken along the line V—V of FIG. 3, thereby showing the portion of the above mentioned heat absorbing passages 10. Also, FIG. 6 shows a cross sectional configuration, a cross sectional view taken along the line VI—VI of FIG. 3, thereby showing the portion of the above mentioned heat exhausting passages 11.

The heat absorbing passage 10 shown in 5 is comprised of a heat absorbing inlet plate 13*a* and a heat absorbing outlet plate 13*b* which are positioned at both upper and lower ends thereof, respectively, and a plurality of intermediate heat absorbing plates 13*c* which are stacked one upon another and positioned between the said plates 13*a* and 13*b*. It has a construction in which each of the heat absorbing plates 13*a*, 13*b* and 13*c* is provided with a path 14 that extends in a direction perpendicular to their stacking direction. And, the path 14 of each of the heat absorbing plates 13*a*, 13*b* and 13*c* has its both sides which are connected to a path 14 for another heat absorbing plate at a pair of joint members 15*a* and 15*b*, respectively. An inlet joint pipe 16*a* and an outlet joint pipe 16*b* which communicate with the respective one side of each of such plural paths 14 are coupled to the said heat absorbing inlet plate 13*a* and the said heat absorbing outlet plate 13*b*, respectively.

The above mentioned plural joint members 15*a* and 15*b* are constructed in such a manner that each joint member 15*a* that is positioned at an upstream side of the inflow direction of the coolant may be provided at its mid position with a partition plate 15*c* and thereby closed and each joint member 15*b* that is positioned at a downstream side of the inflow direction of the coolant may be opening through its mid portion. Thus, it is so constructed that the coolant that has been introduced from the said inlet joint pipe 16*a* may be led to flow in a zigzag pattern as a whole through the said heat absorbing plates 13*a*, 13*c* and 13*b* and be led to flow into the said outlet joint pipe 16*b*.

Figure 6:
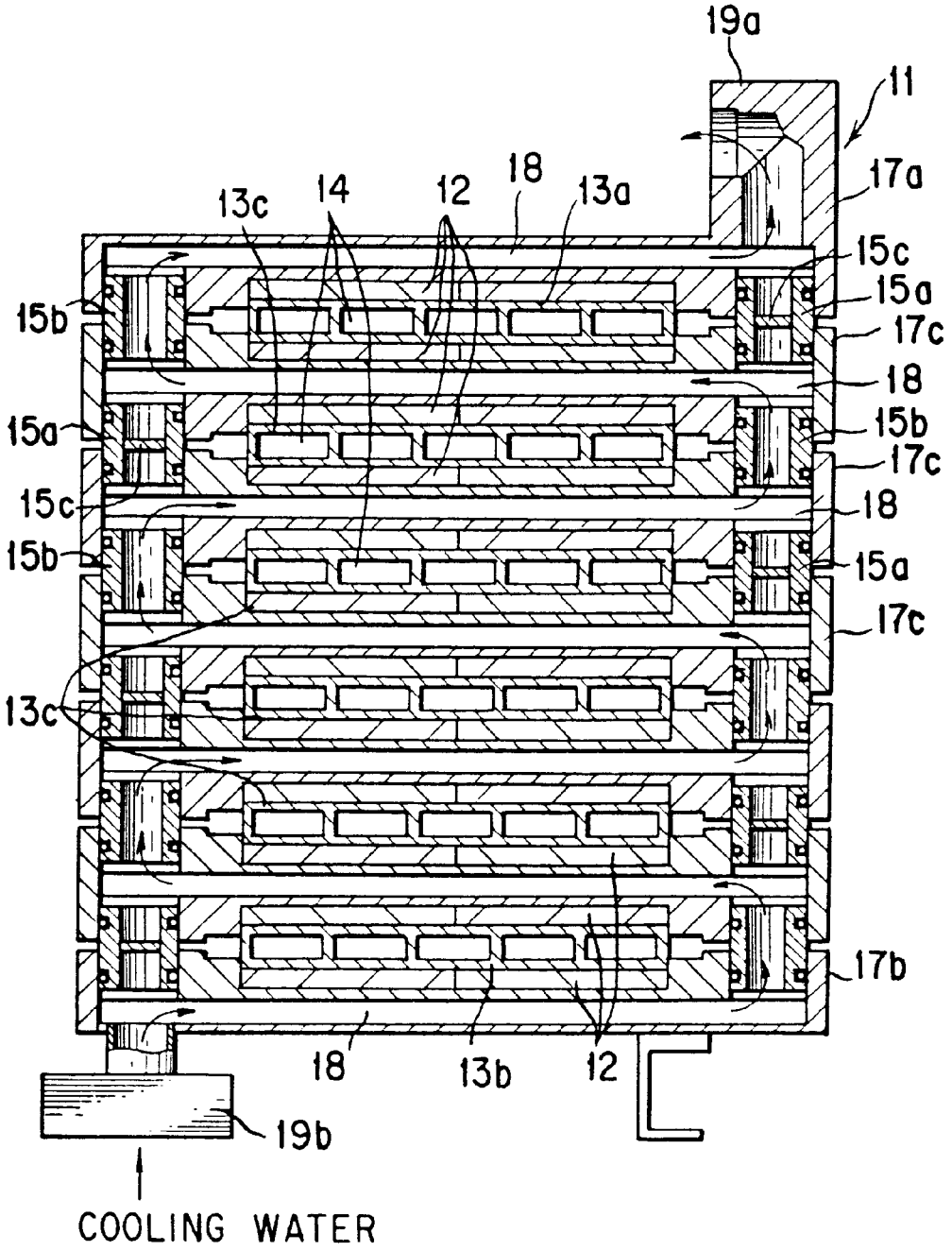
FIG. 6 is a cross sectional view taken along the line VI—VI of FIG. 3.

On the other hand, the said heat exhausting passage 11, as shown in FIG. 6, is constructed of a heat emitting inlet plate 17*a* and a heat emitting outlet plate 17*b* which are positioned at its both ends and a plurality of intermediate heat emitting plate 17*c* which are stacked one upon another and positioned between the said plates 17*a* and 17*b*. And, each of the said heat emitting plates 17*a*, 17*b* and 17*c* is provided with a path 18 that extends in a direction perpendicular to their staking direction. And, the said path 18 of each of the said heat emitting plates 17*a*, 17*b* and 17*c*, like the above mentioned path 14 of each of the said heat absorbing plates 13*a*, 13*b* and 13*c* of the said heat absorbing passage 10, is connected to another path 18 by the said joint member 15*a* provided at its mid portion with the said partition plate 15*c* and the said joint member 15*b* opening through its mid portion so that the cooling water may be led to flow in a zigzag pattern as a whole through such paths 18 in the said heat absorbing plates 17*a*, 17*c* and 17*b*. In this connection, it should be noted that the said paths 18 are connected at their upper and lower ends to the said intermediate heat emitting plates 17*c* via the respective joints members 15 and that an outlet joint 19*a* and an inlet joint 19*b* which communicate with the respective one side of each of the said plural paths 18 are coupled to the said heat emitting outlet plate 17*a* and the said heat emitting inlet plate 17*b*, respectively.

As shown in FIGS. 5 and 6, each of the said heat absorbing plates 13*a*, 13*b* and 13*c* which constitute the above mentioned heat absorbing passage 10 and each of the said heat emitting plates 17*a*, 17*b* and 17*c* which constitute the above mentioned heat exhausting passage 11 are stacked one upon another via a Peltier element 12 and bolted together. And, to the said inlet joint pipe 16*a* and the said outlet joint pipe 16*b* of both the heat absorbing inlet plate 13*a* and the heat absorbing outlet plate 13*b* of the said heat absorbing passage 10, there is connected a coolant circuit 7 as shown in FIG. 2. Also, to the said outlet joint 19*a* and the said inlet joint 19*b* of both the heat emitting outlet plate 17*a* and the heat emitting inlet plate 17*b* of the said heat exhausting passage 11, there is connected a cooling water circuit 20 as shown in FIG. 2. In this connection, it should be noted that an antifreezing liquid is utilized in the above mentioned coolant circuit 7.

Each Peltier element 12 as mentioned above is connected to a control unit 21. This arrangement is constructed in such a manner that by passing an electric current through the said control circuit 21, the heat may be absorbed from each of the said heat absorbing plates 13*a*, 13*b* and 13*c* and may be emitted into each of the said heat emitting plates 17*a*, 17*b* and 17*c*.

In the fluid-fluid heat exchanger of the above mentioned construction, it can be seen that the coolant that has absorbed a heat and has been elevated in temperature while passing through the said heat exchanger 6 within the said air cooling dehumidifier 1 will be circulated through the said heat absorbing passage 10, during which time it will be cooled within each of the said heat absorbing plates 13*a*, 13*b* and 13*c* which collectively constitute the said heat absorbing passage 10 by a heat absorbing action of the said Peltier element 12 in contact therewith.

On the other hand, the cooling water will be circulated through the heat exhausting passage 11 of the said fluid-fluid heat exchanger 9 so that the heat may be emitted by the heat emitting action of the above mentioned Peltier element 12 via each of the said heat emitting plates 17*a*, 17*b* and 17*c* which collectively constitute the said heat exhausting passage 11.

In connection with the above, it should be noted that at the outlet side of the air conditioning apparatus as shown in FIG. 1, there is provided a temperature and humidity sensor 22 for detecting the temperature and humidity so that the above mentioned control device 21 may be responsive to values that are detected by the said temperature and humidity sensor 22 for controlling the fluid-fluid heat exchanger 9, the heater 2 and the humidifier 3 mentioned above.

Also, the said intermediate heat absorbing plates 13*c* and the said intermediate heat emitting plates 17*c* which constitute both the said passages 10 and 11 of the above mentioned fluid-fluid heat exchanger 9 are constructed of common components of an identical configuration. And, the said intermediate heat absorbing plates 13 and the said intermediate heat emitting plates 17*c* can be increased or decreased by an identical number, thereby enabling the heat exchanging capacity of the said fluid-fluid heat exchanger 9 to be adjusted.

In the construction mentioned above, the air that is blown by the said blower 4 will be dehumidified through the said air cooling dehumidifier 1 to a predetermined absolute humidity, the air so dehumidified will be heated through the said heater 2 and the heated air will be humidified through the said humidifier 3 to yield an air stream of a predetermined humidity and a predetermined temperature. At this time, since water droplets condensed on the said air cooling dehumidifier 1 are led to fall onto an area other than the said air blowing outlet 5*a* of the said air duct 5, they will not be allowed to fall from the the said air blowing outlet 5*a*.

And, the air conditioned air will then be detected with respect to its temperature and humidity by the said temperature and humidity sensor 22 that is located in the vicinity of the said air blowing outlet 5*a*. If there is a difference between the detected value(s) and the above mentioned predetermined value(s) in respect of temperature and/or humidity, the said control device 21 will be made operative to increase and decrease the amount(s) of operation at the said heater 2 and/or the said humidifier 3, thus performing a control operation for the temperature and/or the humidity.

Also, a temperature and humidity sensor may be disposed at the inlet side of the flex portion 5*b* of the said air duct 5 whereby the dew-point temperature and the absolute humidity that can be calculated from the temperature and humidity of the inlet air and the absolute humidity that can be calculated from the desired temperature and humidity of the air may be compared with each other to automatically perform the most efficient dehumidifying control operation.

And, the air that has optimally be dehumidified will be led to the said heater 2 where it will be heated to a given temperature, and the heated air will be humidified by the said humidifier 3 to a desired humidity. And, the resultant air will be fed out through the said blower 4. At this point it should be noted that if the said air blowing outlet 5*a* of the said air duct 5 is funnel-shaped as shown in FIG. 1, the air will be expanded at such a funnel-shaped portion.

The air that has be fed out will be detected by the said temperature and humidity sensor 22 that is located at the side of the said air blowing outlet 5*a*. By controlling the said heater 2 and the said humidifier 3 in accordance with its detected values, it should be noted that the temperature and the humidity of the air will be controlled within an accuracy of ±0.01° C. and ±0.1% RH.

In the above mentioned operation, if the said air cooling dehumidifier 1 and the said heater 2 are arranged not to be directly opposite to each other, the said air cooling dehumidifier 1 will have an influence thereon reduced that arises from a heat of radiation which is emitted from the said heater 2.

Also, in the above mentioned air cooling dehumidifier 1, it should be noted that if the coolant while passing therethrough is allowed to flow in a direction that is opposite to a direction in which the air flows therethrough, the rise of the temperature of the coolant can be increased, thereby improving the coolant-air heat exchanging efficiency.

The coolant that has absorbed a heat and has thereby been elevated in temperature in the said air cooling dehumidifier 1 will, while passing through the said fluid-fluid heat exchanger 9, be heat emitted by the heat absorbing action of a said Peltier element 12 towards the cooling water side as mentioned previously. Thence, if in the said fluid-fluid heat exchanger 9 the coolant and the cooling water are led to flow in an opposition to each other or to flow orthogonally to each other as shown in the above mentioned embodiment, it should be noted that the operating point of a said Peltier element 12 can be so established as to allow an enhanced efficiency of the operation, thereby permitting a heat transfer from the coolant to the cooling air to be carried out efficiently.

An explanation will now be given with respect to the high efficiency operation of the said Peltier element 12 with reference to FIG. 7.

Figure 7:
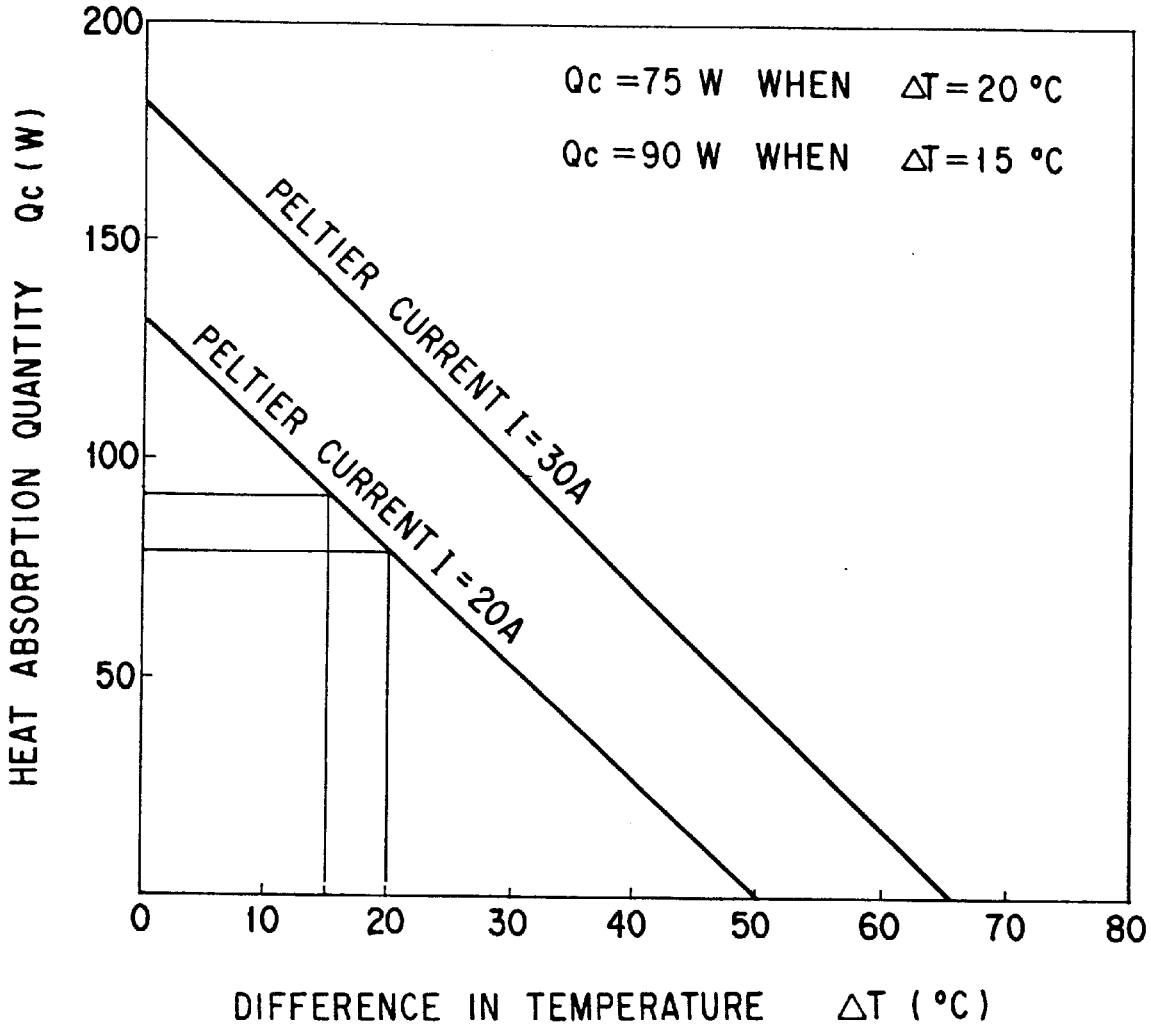
FIG. 7 is a graph illustrating the characteristics of a Peltier element.

In the graph of FIG. 7, the abscissa represents the difference in temperature ΔT between the heat absorbing surface and the heat emitting surface of the said Peltier element 12, that is, the difference in temperature between the coolant and the cooling water whereas the ordinate represents the heat absorption quantity Qc. From this graph, it is seen that the greater the the difference in temperature ΔT, the less will be the heat absorption quantity Qc. One may consider that given the temperatures of the coolant and the cooling water, ΔT will be constant; this is not so, however. In a case where the coolant, for example, of 0° C., that has been cooled by the said Peltier element 12 via the heat absorbing plate 10 absorbs a heat from the air while it is passed through the said air cooling dehumidifier 1 to raise its temperature to 10° C. and is then returned via the pump 8 again to the said heat absorbing plate 10, the arithmetic average temperature of the heat absorbing surface will be 5° C. and, if the cooling water has a temperature of 20° C., the difference in temperature ΔT will be 15° C. Since the temperature rise varies depending upon the manner in which the coolant is led to flow towards the said air cooling dehumidifier 1, it will be understood that it is also possible to alter the difference in temperature in the said Peltier element 12. Whilst the difference in temperature AT ought to be calculated in terms of the logarithmic average temperature since the temperature of the cooling water, too, is elevated in practice, it can be seen that there is no difference between them in that the average difference in temperature can be altered. More specifically, in the said air cooling dehumidifier 1, it is important that an arrangement be made in which the air and the coolant flow in directions that are opposing to each other in order to reduce the rate of flow of the coolant. Also, in the said fluid-fluid heat exchanger 9 as well, it will be seen that by making an arrangement in which the cooling water and the coolant flow in directions that are opposite to each other, the difference in temperature ΔT (i. e. the average temperature difference) between the heat absorbing surface and the heat emitting surface of a said Peltier element 12 can be reduced.

Figure 8:
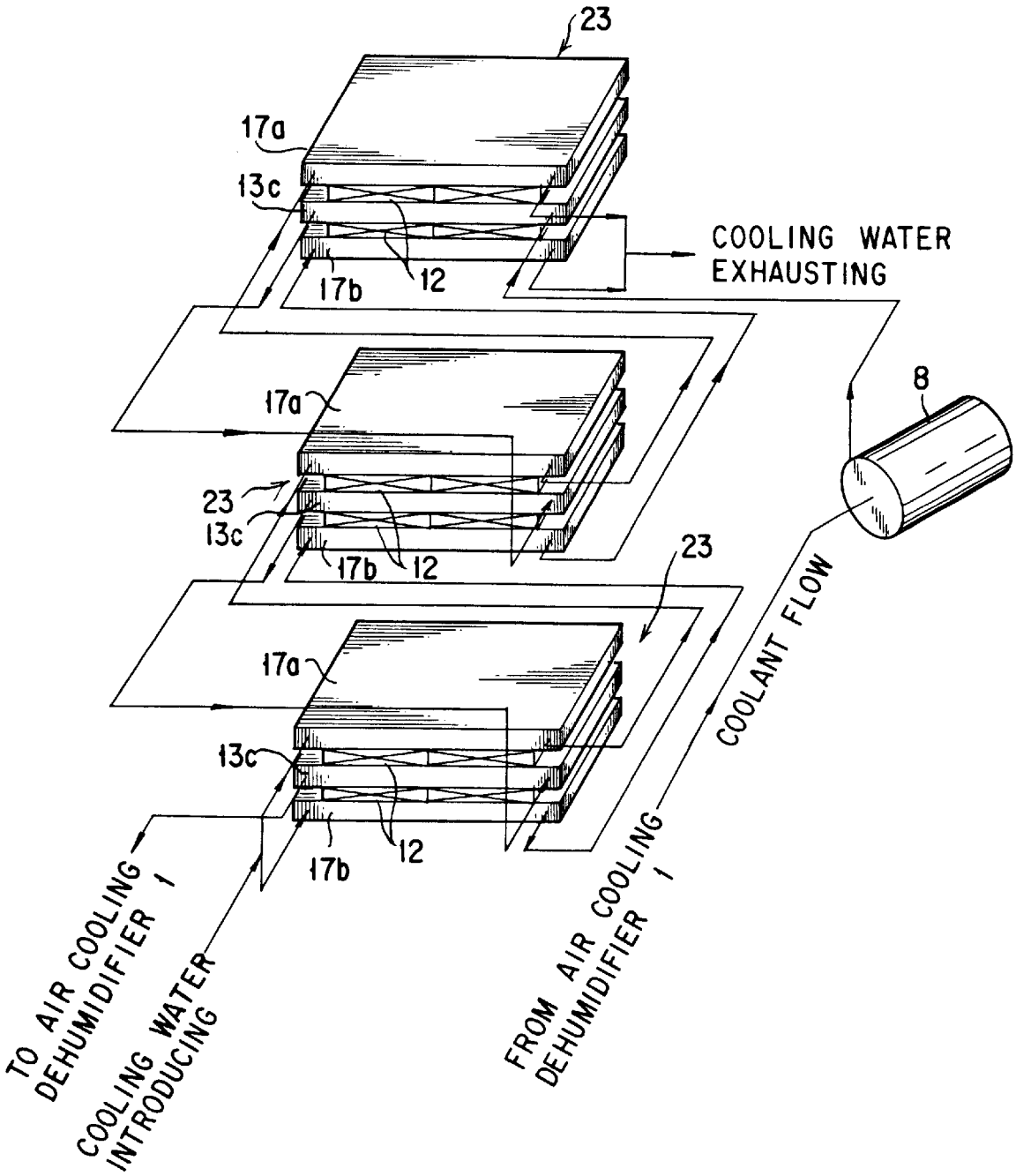
FIG. 8 is a schematic constructive view diagrammatically illustrating another example of the fluid-fluid heat exchanger that can be used in the above mentioned embodiment of the present invention.

FIG. 8 shows another embodiment of the fluid-fluid heat exchanger in which a plurality of heat exchanger units are utilized each unit having a stack of a first heat emitting plate 17*a,* a heat absorbing plate 13*c* and a second heat emitting plate 17*b* in which the heat absorbing plate 13 is interposed between a pair of the heat emitting plates 17*a* and 17*b* via two Peltier elements 12 and 12, respectively. In this construction, it is seen that the coolant that is supplied by a pump 8 is led to flow through the respective heat absorbing plates 13 of the said plural heat exchanger units 23 in series whereas the cooling water is led to flow though the said two heat emitting plates 17*a* and 17*b* of each heat exchanger unit 23 in parallel and is led to flow though the heat emitting plates 17*a,* 17*b* of the said plural heat exchange units 23 in series.

Figure 9:
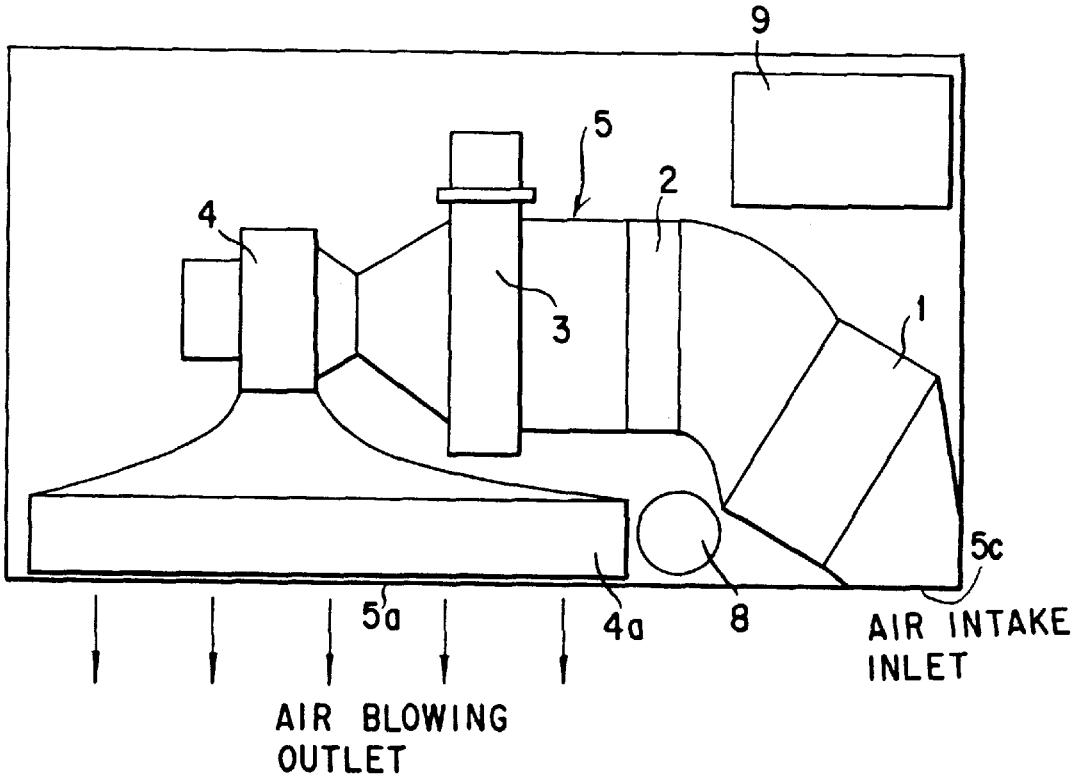
FIG. 9 is an entire constructive view illustrating another embodiment of the air conditioning apparatus according to the present invention.

Also, FIG. 9 shows the entire construction of another embodiment of the air conditioning apparatus according to the present invention, in which construction an air intake inlet 5*c* of the air duct 5 is directed downwards.

As set out in the foregoing, according to the present invention, the condensed water produced within the air conditioning apparatus is not allowed to drop from the air blowing outlet 5*a* of the air duct 5. Also, the air conditioning apparatus according to the present invention allows the heat exchanger required to exhaust the heat that is absorbed in the air cooling dehumidifier 1 to be much small sized as well as light weighted compared with a conventional apparatus utilizing a compression refrigerator and is capable of eliminating a generation of vibrations therein. Also, the apparatus according to the present invention is rendered the most efficient among systems utilizing a Peltier element, thereby permitting the entire air conditioning equipment to be small sized as well as light weighted. In addition, with the capability of separating the condensed water that is exhausted during an air conditioning operation from the air and the capability of installing itself directly upon an operating section of a spin coating equipment or the like, the apparatus herein provided allows an ultra-high-precision operation to be implemented and can be prevented from occupying an expensive clean room flour space.

Furthermore, by increasing or decreasing the numbers of the heat absorbing plates and the heat emitting plates as well as the the number of the Peltier elements 12, it can be seen that the capacity of the heat exchanger constituted thereby can readily be changed. Thus, it will be noted that the air processing capacity in the air cooling dehumidifier 1 can thereby be readily adjusted as desired, without altering the cross sectional area of the air duct. Also, owing to the fact that the air-fluid heat exchanger 6 and the fluid-fluid heat exchanger 9 are separated from each other, it will be apparent that the maintenance operation for the air conditioning apparatus can be facilitated.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. An air conditioning apparatus, comprising: an air duct and provided therein with a blower; a heater; a humidifier; an air cooling dehumidifier comprised of a heat exchanger, wherein said air cooling dehumidifier is disposed at a site that is shifted transversely from an air blowing outlet of said air duct, said air from said air duct turning transversely immediately following said dehumidifier, wherein said air duct has a bent portion, wherein said air cooling dehumidifier and said heater are disposed ahead of and behind of said bent portion, respectively, and wherein said bent portion of said air duct is provided with a flex portion.

2. An air conditioning apparatus as set forth in claim 1, further comprising a heat absorbing plate and a heat emitting plate arranged and stacked one upon the other such that a path disposed in said heat absorbing plate and a path disposed in said heat emitting plate extend orthogonally to each other; and a Peltier element interposed between said heat absorbing plate and said heat emitting plate.

3. An air conditioning apparatus as set forth in claim 1, further comprising a heat absorbing plate and a heat emitting plate so arranged and stacked one upon the other such that a path disposed in said heat absorbing plate and a path disposed in said heat emitting plate extend in parallel to each other; and a Peltier element interposed between said absorbing plate and said heat emitting plate.

4. An air conditioning apparatus, comprising: an air duct and provided therein with a blower; a heater; a humidifier; and an air cooling dehumidifier comprised of a heat exchanger, wherein said air cooling dehumidifier is disposed at a site that is shifted transversely from an air blowing outlet of said air duct, and wherein said air duct is provided with a flex portion and that said air cooling dehumidifier and said heater are disposed ahead of, and behind of, said flex portion, respectively.

5. An air conditioning apparatus as set forth in claim 4, further comprising a heat absorbing plate and a heat emitting plate arranged and stacked one upon the other such that a path disposed in said heat absorbing plate and a path disposed in said heat emitting plate extend orthogonally to each other: and a Peltier element interposed between said heat absorbing plate and said heat emitting plate.

6. An air conditioning apparatus as set forth in claim 4, further comprising a heat absorbing plate and a heat emitting plate so arranged and stacked one upon the other such that a path disposed in said heat absorbing plate and a path disposed in said heat emitting plate extend in parallel to each other; and a Peltier element interposed between said absorbing plate and said heat emitting plate.

* * * * *